United States Patent [19]

Nozawa

[11] Patent Number: 4,589,265

[45] Date of Patent: May 20, 1986

[54] HEAT EXCHANGER FOR AN AIR CONDITIONING SYSTEM EVAPORATOR

[75] Inventor: Kazuo Nozawa, Konan, Japan

[73] Assignee: Diesel Kiki Company, Ltd., Tokyo, Japan

[21] Appl. No.: 669,400

[22] Filed: Nov. 8, 1984

[30] Foreign Application Priority Data

Nov. 14, 1983 [JP] Japan ..... 58-175734

[51] Int. Cl.[4] ..... F25B 39/02; F25B 41/06; F28D 1/02

[52] U.S. Cl. ..... 62/526; 62/527; 165/152; 165/153; 165/176

[58] Field of Search ..... 165/40, 176, 153, 150, 165/151, 152; 62/524, 525, 526, 516, 527, 528

[56] References Cited

U.S. PATENT DOCUMENTS

| | | | |
|---|---|---|---|
| 2,820,617 | 1/1958 | Tadewald | 165/176 |
| 4,114,397 | 9/1978 | Takahashi et al. | 62/516 |
| 4,149,390 | 4/1979 | Iijima et al. | 165/176 |
| 4,217,953 | 8/1980 | Sonoda et al. | 62/525 |
| 4,274,482 | 6/1981 | Sonoda | 165/176 |
| 4,370,868 | 2/1983 | Kim et al. | 165/153 |

FOREIGN PATENT DOCUMENTS

| | | | |
|---|---|---|---|
| 2248482 | 6/1975 | France | 165/160 |
| 0092735 | 6/1983 | Japan | 165/150 |

*Primary Examiner*—William R. Cline
*Assistant Examiner*—John K. Ford
*Attorney, Agent, or Firm*—David G. Alexander

[57] ABSTRACT

A heat exchanger includes a plurality of hollow panels arranged in a stack with fins interspersed therebetween and each having a fluid passageway therein and an upper header and a lower header at opposite sides of the fluid passageway. An end plate is applied to at least one end of the stack and formed with an inlet opening and an outlet opening in nearby positions which communicate to a fluid circulation path defined in the stack by the fluid passageways and the upper and lower headers of the hollow panels. An inlet and outer manifold block is mounted on the end plate for fluidly communicating the inlet opening of the end plate to an inlet conduit and the outlet opening to an outlet conduit. An expansion valve is disposed within the inlet and outlet manifold block for controlling the quantity of an incoming flow of fluid directed from the inlet conduit toward the fluid circulation path in the stack via the manifold block and the inlet opening of the end plate in response to a temperature and a pressure of an outgoing flow of the fluid directed from the fluid circulation path toward the outlet conduit via the outlet opening of the end plate and the manifold block.

6 Claims, 10 Drawing Figures

HEAT EXCHANGER FOR AN AIR CONDITIONING SYSTEM EVAPORATOR

BACKGROUND OF THE INVENTION

The present invention relates to a heat exchanger such as a laminate evaporator for an air conditioning system of a motor vehicle or the like.

The type of heat exchanger to which the present invention constitutes a novel and advantageous improvement comprises a plurality of generally flat, hollow panels which are stacked together with corrugated plates or the like interspersed therebetween, and end plates applied to both ends of the stacked panel and corrugated plate assembly.

Where the heat exchanger is used an an evaporator, a refrigerant fed into the bores flows through the hollow panels along a zig-zag path and passes out of the evaporator. Air to be cooled is pumped through the corrugated plates. The refrigerant flowing through the panels absorbs heat from the air, thereby lowering the temperature thereof.

An inlet conduit extends outs from a refrigerant inlet which is formed through one of the opposite end plates and has an expansion valve therewith, while an outlet conduit extends out from an refrigerant outlet which then is inevitably formed through the other end plate to provide the zig-zag refrigerant path. Such a relative position of the inlet and outlet, however, gives rises to some problems. Since a temperature-sensing bulb and an external equalizer responsive respectively to the temperature and pressure in the outlet conduit are incorporated in the expansion valve of the prior art heat exchanger, it is necessary to position the expansion valve near the outlet conduit traversing the front face of the heat exchanger. The expansion valve located in front of the heat exchanger constitutes resistance to the flow of air which is detrimental to the performance of the heat exchanger. In addition, the cost of the prior art heat exchanger is disproportionate due to the provision of the expansion valve, temperature-sensing bulb and external equalizer which are separate from each other and intercommunicated by tubings.

SUMMARY OF THE INVENTION

It is therefore an object of the present invention to provide a heat exchanger which sets up an uninterrupted smooth flow of air therethrough so as to accomplish a desirable performance.

It is another object of the present invention to provide a heat exchanger which attains a cost-effective construction by integration of various structural elements.

It is another object of the present invention to provide a generally improved heat exchanger.

A heat exchanger of the present invention comprises a plurality of hollow panels arranged in a stack with fins interposed therebetween and each having a fluid passageway therein and an upper header and a lower header at opposite sides of the fluid passageway. An end plate is applied to an end of the stack and formed with an inlet opening and an outlet opening adjacent to the inlet opening each of which communicates to a fluid circulation path defined in the stack by the fluid passageways and the upper and lower headers of the hollow panels. An inlet and outlet manifold assembly is mounted on the end plate for fluidly communicating the inlet opening of the end plate to an inlet conduit and the outlet opening to an outlet conduit. An expansion valve is built in the inlet and outlet manifold assembly for controlling a quantity of an incoming flow of fluid directed from the inlet conduit toward the fluid circulation path in the stack via the manifold assembly and the inlet opening of the end plate in response to a temperature and a pressure of an outgoing flow of the fluid directed from the fluid circulation path toward the outlet conduit via the outlet opening of the end plate and the manifold assembly.

In a preferred embodiment of the present invention, the inlet and outlet manifold assembly comprises an inlet and outlet manifold block which is provided with a first passageway for the incoming flow of the fluid and a second passageway for the outgoing flow of the fluid.

The heat exchanger further comprises an arrangement for fixing the inlet and outlet manifold assembly to the end plate.

Preferably, the fixing arrangement comprises a mounting plate which is formed with openings aligning respectively with the inlet and outlet openings of the end plate and is rigidly connected to the end plate by brazing.

Desirably, the fixing arrangement may further comprise a screw and a nut assembly for fastening the manifold block to the mounting plate.

The above and other objects, features and advantages of the present invention will become apparent from the following detailed description taken with the accompanying drawings.

DESCRIPTION OF THE PREFERRED EMBODIMENTS

While the heat exchanger of the present invention is susceptible of numerous physical embodiments, depending upon the environment and requirements of use, substantial numbers of the herein shown and described embodiments have been made, tested and used, and all have performed in an eminently satisfactory manner.

To facilitate understanding of the present invention, a brief reference will be made to a prior art heat exchanger embodied as a laminate evaporator, shown in FIG. 1.

Figure 1:
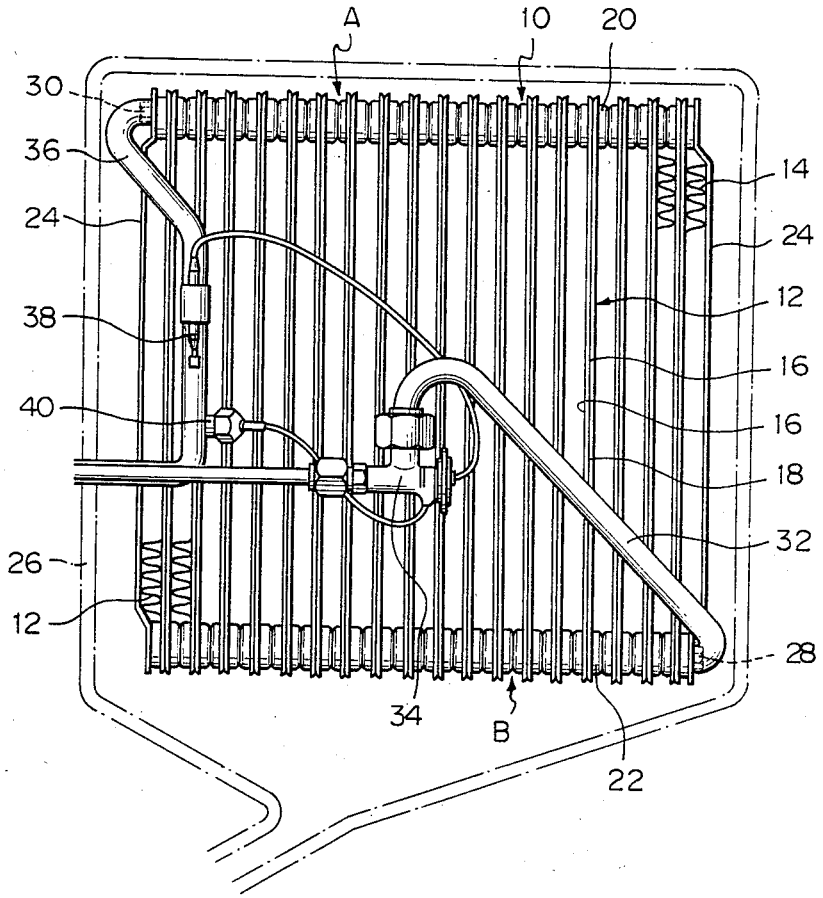
Fig. 1 PRIOR ART
FIG. 1 is a front view of a prior art heat exchanger constructed to serve as an evaporator.

Referring to FIG. 1, the laminate evaporator, generally 10, comprises a plurality of flat, hollow panels 12 which are stacked together with corrugated plates, or fins, 14 interspersed therebetween. Each hollow panel 12 is made up of a pair of shaped plates 16 which are connected together to define in the panel 12 a refrigerant passageway 18 and headers 20 and 22 at opposite sides of the passageway 18. End plates 24 are applied to opposite ends of the panel and corrugated plate assembly as illustrated. The evaporator 10 is installed in a casing 26 of an air conditioning system such that the headers 20 and 22 are positioned one above the other. While air flowing through the casing 26 passes through the spacings between the nearby panels, or heat exchanging elements, 12, its temperature is lowered by the refrigerant which is propagating through the passageways 18.

The upper headers 20 of the nearby hollow panels 12 are intercommunicated except for a particular portion of the assembly, labeled A in FIG. 1, while the lower headers 22 of the nearby hollow panels 12 are intercommunicated except for a particular portion labeled B, so that the refrigerant is caused to follow a zig-zag path in the evaporator 10. In this construction, where a refrigerant inlet 28 is formed through one of the end plates 24, a refrigerant outlet 30 is inevitably formed through the other end plate 24. This is undesirable as previously outlined.

In detail, an inlet conduit 32 extends out from the refrigerant inlet 28 in one end plate 24 and has an expansion valve 34 therewith, while an outlet conduit 36 extends out from the refrigerant outlet 30 in the other end plate 24. Such a relative position of the inlet and outlet, however, gives rise to some problems. Since a temperature-sensing bulb 38 and an external equalizer 40 responsive respectively to the temperature and pressure in the outlet conduit 36 are associated with the expansion valve 34, it is necessary to position the expansion valve 34 near the outlet conduit 36 traversing the front face of the heat exchanger 10 as illustrated. The expansion valve 34 located in front of the heat exchanger 10 constitutes resistance to the flow of air which is detrimental to the performance of the heat exchanger. In addition, the cost of the prior art heat exchanger is disproportionate due to the provision of the expansion valve 34, temperature-sensing bulb 38 and external equalizer 40 which are separate from each other and intercommunicated by tubings.

Reference will now be made to FIGS. 2–9 for describing a preferred embodiment of the present invention which solves the problems discussed above.

Figure 2:
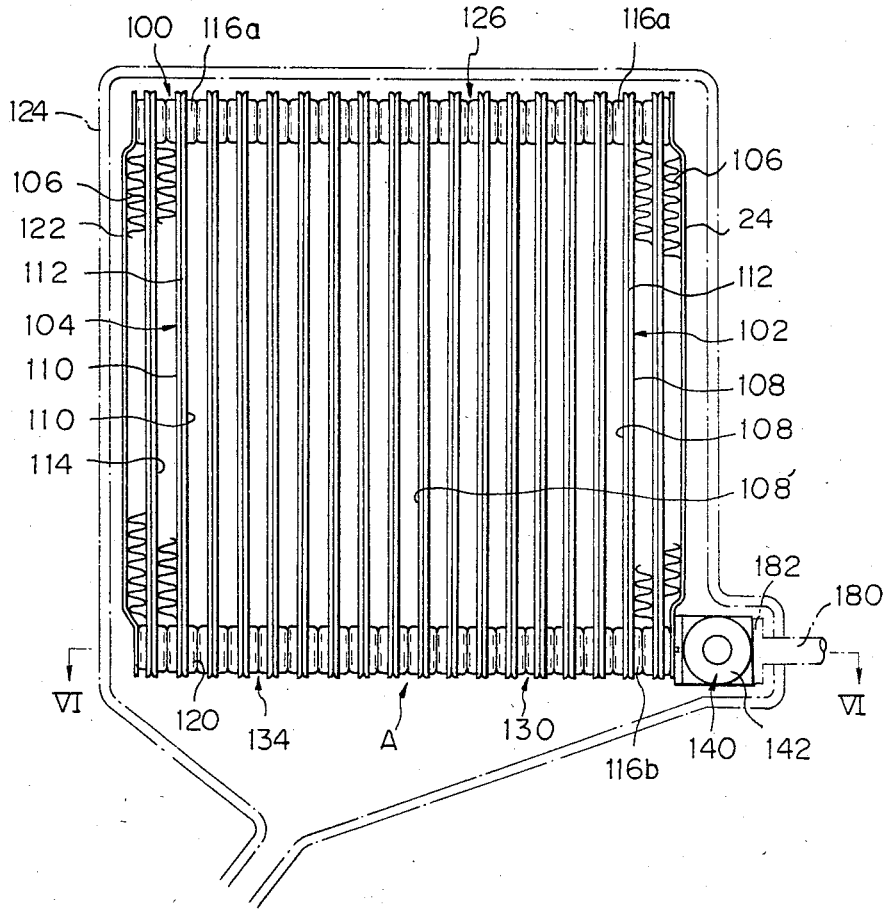
FIG. 2 is a front view of a heat exchanger embodying the present invention and also serving as an evaporator.

Referring to FIG. 2, an evaporator, generally 100, comprises hollow panels 102 and 104 and corrugated plates, or fins, 106 which are alternately stacked together. Each of the hollow panels 102 comprises a pair of shaped plates 108 and each of the hollow panels 104, a pair of shaped plates 110. In the illustative embodment, the panels 102 constitute a right half of the evaporator 100 and the panels 104, a left half. The plates 108 and 110 are somewhat different in configuration from each other as will be described.

Figure 3:
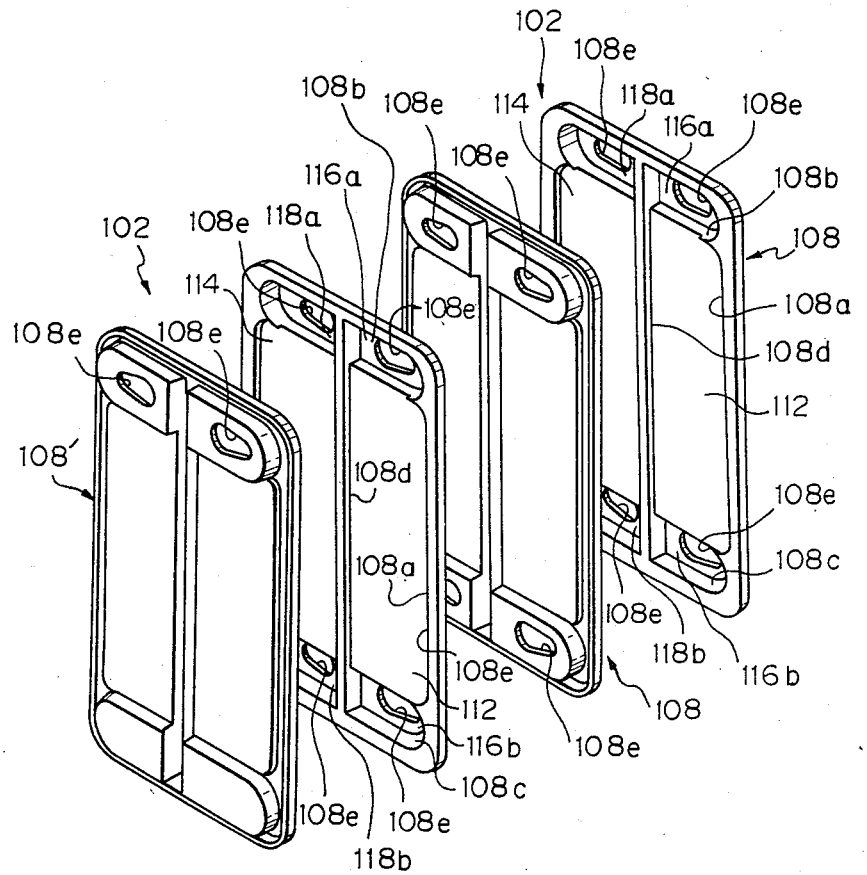
FIGS. 3 an 4 are exploded perspective views of two different configurations of hollow panels included in the evaporator shown in FIG. 2.

As shown in detail in FIG. 3, each plate 108 except for the leftmost one which is labelled 108' is provided with a relatively shallow recess **108*a* in a central area thereof and recesses 108*b* and 108*c* at opposite sides of the recess 108*a*, the recesses 108*b* and 108*c* each being deeper than the recess 108*a*. A lug 108*d* extends in the lengthwise direction of the plate 108 to serve as a wall which bisects each of the recesses 108*a*, 108*b* and 108*c*. Openings 108*e* are formed through the plate 108 in the two parts of each deep recess 108*b* or 108*c*. The leftmost plate 108' in the right half of the evaporator 100 is identical in configuration with the plates 108 except that it has openings 108*e* formed only in the two parts of the upper deep recesses 108*b***.

The plates 108 inclusive of the plate 108' are joined together along their mating surfaces to provide the hollow panels 102. As also shown in FIG. 2, the paired plates 108 define therebetween two refrigerant passageways 112 and 114 in a central area, headers **116*a* and 116*b* at opposite sides of the passageway 112, and headers 118*a* and 118*b* at opposite sides of the passageway 114. Each of the headers 116*a* and 116*b* is communicated to the passageway 112, and each of the headers 118*a* and 118*b* to the passageway 114**.

Figure 4:
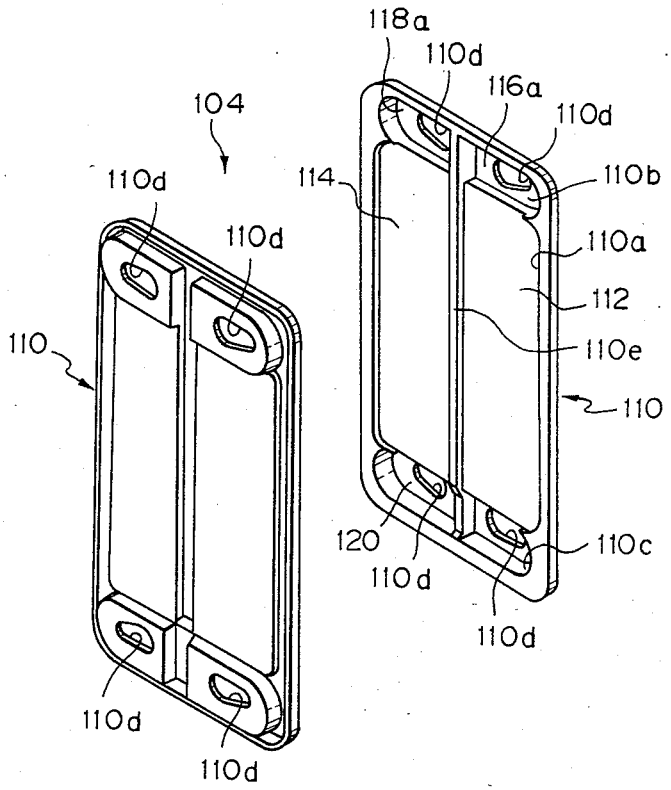
Figure 5:
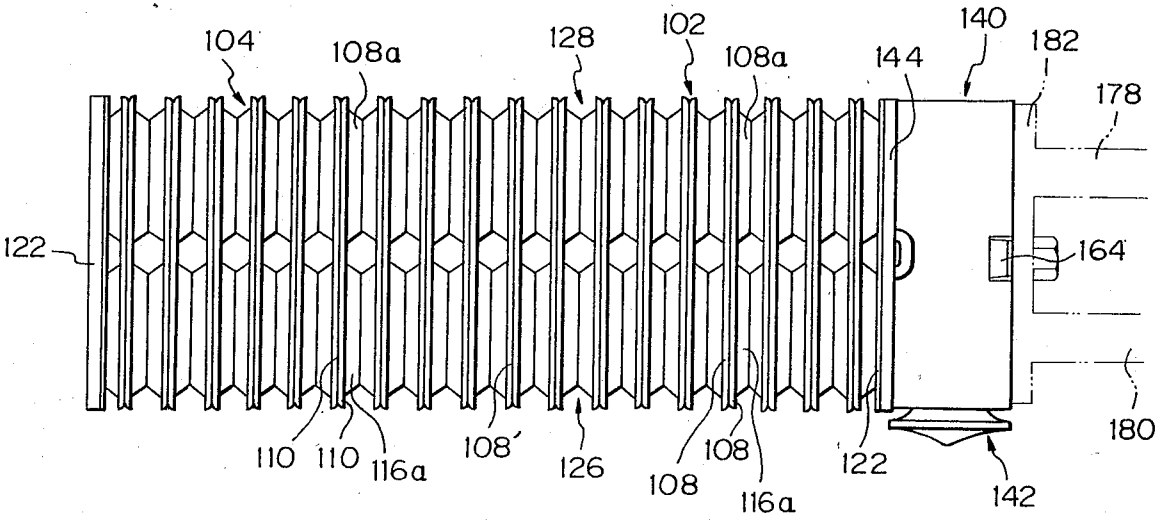
FIG. 5 is a plan view of the evaporator shown in FIG. 2.

Meanwhile, as shown in FIG. 4, each plate 110 in the left half of the evaporator 100, like the plate 108 in the right half, is provided with a shallow recess **110*a*, deep recesses 110*b* and 110*c*, openings 110*d*, and an elongate lug or wall 110*e* bisecting the recesses 110*a*, 110*b* and 110*c*. What distinguishes the plate 110 from the plate 108 is the configuration of the lug 110*e*, that is, the height of the lug 110*e* is reduced in the lower deep recess 110*c*. When mated, the plates 110, like the plates 108, define the passageways 112 and 114, and the headers 116*a* and 118*a* and a header 120 at opposite sides thereof. Since the lugs 110*e* of the mated plates 110 are individually lowered in their associated lower deep receses 120 as described above, the single lower header 120 is defined by the deep recesses 110*c* with the lugs 110*e*** spaced apart from each other.

As previously described, the hollow panels 102 and 104 are stacked together with the corrugated fins 106 interspersed therebetween. An end plate 122 is fixedly mounted on at least one end of the stack. In the illustrative embodiments, end plates 122 are mounted on both ends of the stack. The evaporator 100 thus constructed is disposed in a casing 124 of an air conditioning system in such a position that the headers **116*a* and 118*a* are located above the headers 116*b*, 118*b* and 120**.

As viewed from the end of the heat exchanger which is formed with an inlet opening 136 and an outlet opening 138 (refer also to FIG. 7), all the left upper headers **116*a* of the nearby hollow panels 102 and 104 are intercommunicated by the openings 108*b* and 110*d* to constitute a third intermediate header group 126. Likewise, all the right upper headers 118*a* are intercommunicated by the openings 108*e* and 110*d* to constitute a first intermediate header group 128**.

Figure 6:
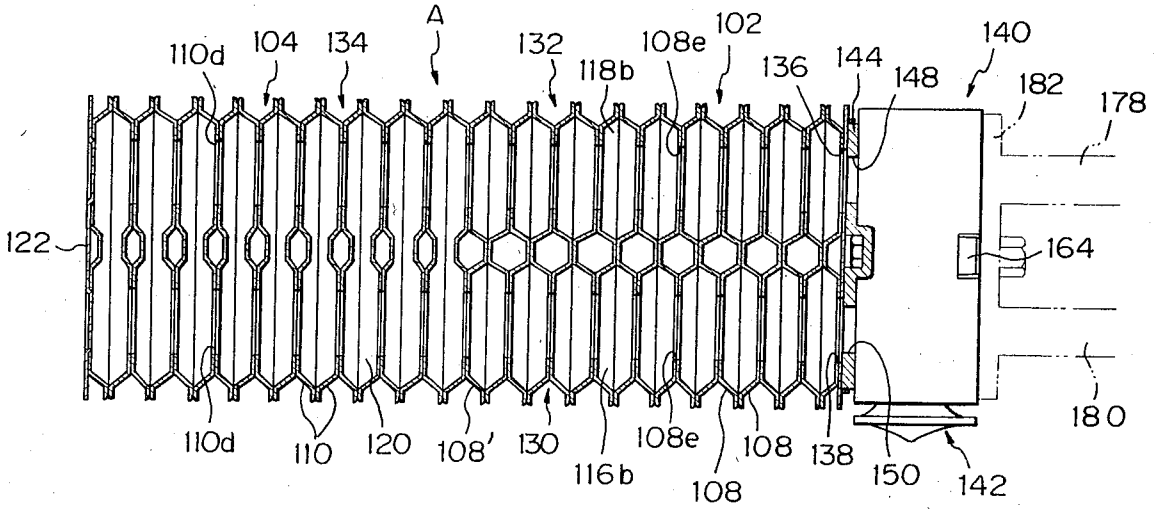
FIG. 6 is a section along line VI—VI of FIG. 2.
Figure 7:
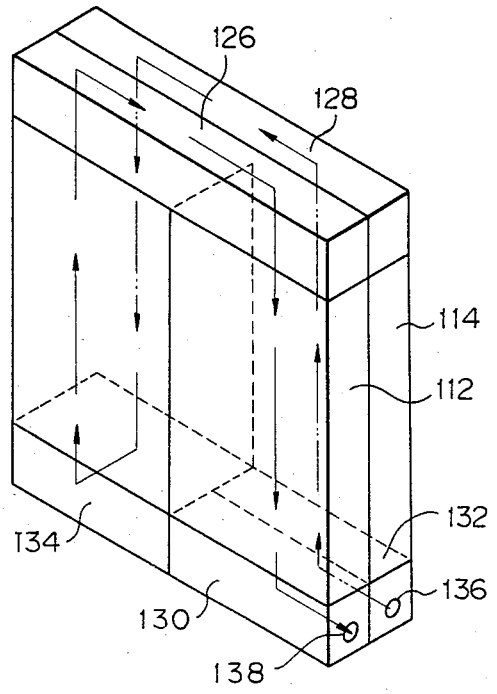
FIG. 7 is a schematic diagram showing a flow of a refrigerant inside the evaporator in accordance with the present invention.
Figure 8:
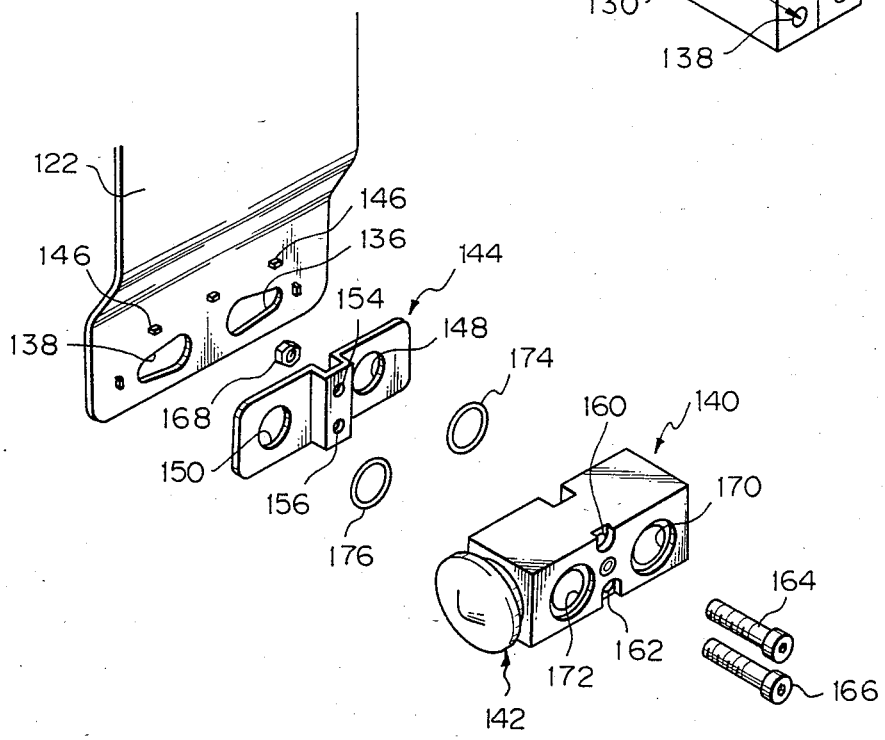
FIG. 8 is an exploded view of an inlet and outlet block with an expansion valve built therein which is included in the evaporator of FIG. 2.

Meanwhile, all the lower headers **116*b*, 118*b* and 120 of the nearby hollow panels 102 and 104 are intercommunicated by the openings 108*e* and 110*d* except for a portion labeled A in FIGS. 2 and 6. The front headers 116*b* in the left half of the evaporator 100 constitute a header group 130 adjacent to the outlet opening 138, while the front headers 118*b* constitute a header group 132 adjacent to the inlet opening 136. Further, the headers 120 in the rear half of the evaporator 100 constitute a second intermediate header group 134. As shown in FIG. 6, the end plate 122 mounted on the right end of the evaporator 100 is provided with the inlet opening 136 and the outlet opening 138**.

In the construction described above, as shown in FIG. 7, refrigerant entering through the inlet 136 into the inlet header group 132 is routed forwardly and then backwardly through the fluid circulation path, i.e., the passageway 114, first intermediate header group 128, passageway 114, second intermediate header group 134, passageway 112, third intermediate header group 126, passageway 112 and outlet header group 130 in this order. The refrigerant leaves the outlet header group 130 through the outlet 138.

The inlet 136 and outlet 138 for the refrigerant is located adjacent to each other in that end plate 122 which abuts against the lower headers **116*b* and 118*b* which constitute the inlet header group 132 and the other header group 130, respectively. An inlet and outlet block, or manifold block, 140 carrying an expansion valve 142 therewith is rigidly connected to the end plate 122** by a fixing arrangement which will be described hereinafter.

A mounting plate 144 is fixed to the end plate 122 while being positioned by lugs 146 which are formed on the end plate 122. The mounting plate 144 is formed with openings 148 and 150 which align respectively with the inlet 136 and outlet 138 of the end plate 122. The plate 144 includes a generally U-shaped projection 152 intermediate between its opposite ends. The projection 152 is provided with bolt holes 154 and 156. The inlet and outlet manifold block 140 comprises a body 158 which is provided with bolt holes 160 and 162. Bolts 164 and 166 respectively are inserted into the bolt holes 160 and 162 of the body 158 and then into the bolt holes 154 and 156 of the mounting plate 144. A nut 168 is screwed over the tip of each of the bolts 164 and 166 inside the projection 152, thereby fastening the manifold block 140 to the mounting plate 144.

Figure 9:
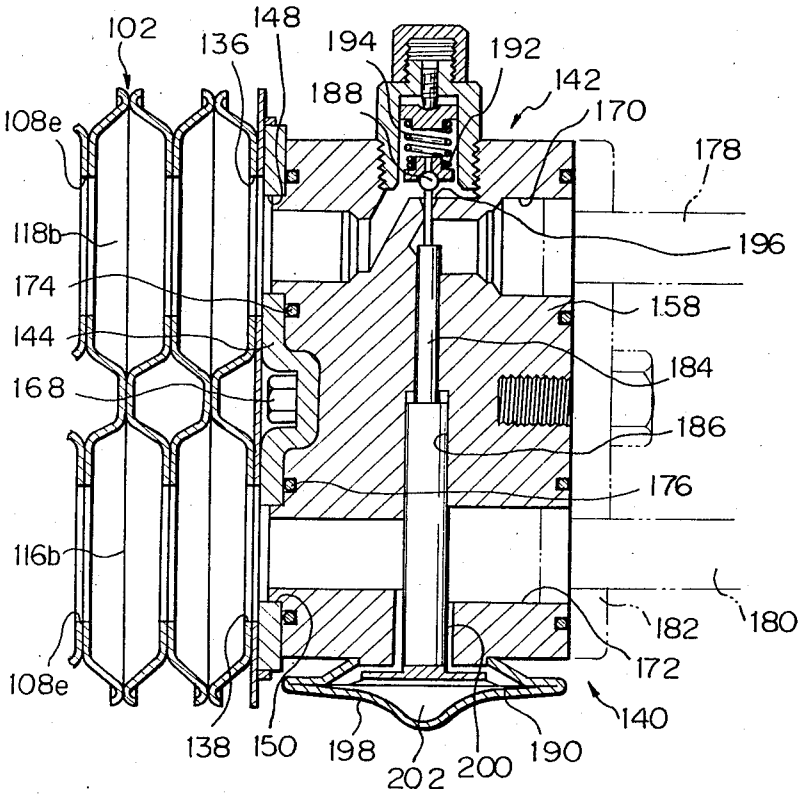
FIG. 9 is a sectional view of the inlet and outlet block shown in FIG. 8.

As shown in detail in FIG. 9, a first passageway 170 for an incoming flow of refrigerant and a second passageway 172 for an outgoing flow of refrigerant extend throughout the body 158 of the manifold block 140 and have their one end aligned respectively with the openings 148 and 150 of the mounting plate 144. O-rings 174 and 176 are interposed between the manifold block 140 and the mounting plate 144 in order to insure sealed communication between the first or inlet passageway 170 and the opening 148 and between the second or outlet passageway 172 and the opening 150, respectively. An inlet conduit 178 and an outlet conduit 180 are connected to the manifold block 158 through a retainer plate 182 which is bolted to the latter, the inlet conduit 178 communicating to the other end of the inlet passageway 170 and the outlet conduit 180 to that of the outlet passageway 172. Although not shown in the drawings, the inlet conduit 178 extends from the manifold block 140 to a condenser via a liquid reservoir, and the outlet conduit 180 to a suction port of a compressor, thereby completing a closed refrigeration cycle.

The expansion valve 142 includes a spool 184 slidably received in a bore 186 which extends through the block body 158 in the lengthwise direction of the latter. A spherical valve member 188 is rigidly mounted on one end of the spool 184. The other end of the spool 184 is connected to a flexible diaphragm 190. The valve member 188 is held in abutting engagement with a spring retainer 192 on which a valve spring 194 is seated. A restriction, or orifice, 196 is defined between the valve member 188 and a valve seat portion (no numeral) of the block body 158 disposed in the inlet passageway 170. The diaphragm 190 is retained by a housing 198 along its edge in such a manner as to divide the interior of the housing 198 into chambers 200 and 202. The chamber 200 is communicated to the outlet passageway 172 so that the discharged refrigerant flowing through the latter is admitted into the former. The chamber 202, on the other hand, is filled with gas whose volume changes with the temperature of the refrigerant communicated to the chamber 200. In this construction, the valve spool 194 with the valve member 188 is movable to a position which is determined by the balance between the diaphragm 190 and the valve spring 194, so that the effective sectional area of the restriction 196 and, therefore, the quantity of incoming refrigerant is automatically controlled to maintain the heating degree of the outgoing refrigerant constant.

In operation, the liquid refrigerant delivered from the condenser enters the inlet passageway 170 and, while flowing through the restriction 196, it turns to low-temperature vapor. Entering the inlet opening 136, the vapor is circulated through the headers **116*a*, 116*b*, 118*a*, 118*b* and 120 and passageways 112 and 114 in the evaporator and, during the course of the circulation, it evaporates absorbing heat from the ambient air. The evaporated refrigerant, or gas, is discharged through the outlet opening 138 and then returned to the compressor by way of the outlet passageway 172 and outlet conduit 180**.

A method of producing the laminate evaporator in accordance with the illustrative embodiment will be described. First, the hollow panels 102 and 104 and the corrugated plates 106 are stacked one after another and the end plates 122 are applied to opposite ends of the hollow panel and corrugated plate assembly. Then, the mounting plate 144 is arranged in a predetermined position on the right end plate 122. The various structural elements mentioned so far are then brased in a furnace to become integral with each other. Thereafter, the manifold block 140 with the expansion valve 142 is fastened to the mounting plate 144 by means of the bolts 164 and 166 and nuts 168 with the O-rings 174 and 176 interposed therebetween. This is followed by connecting the inlet conduit 178 and outlet conduit 180 to the manifold block 140 through the retainer plate 182 so as to install the evaporator in a refrigeration cycle.

Figure 10:
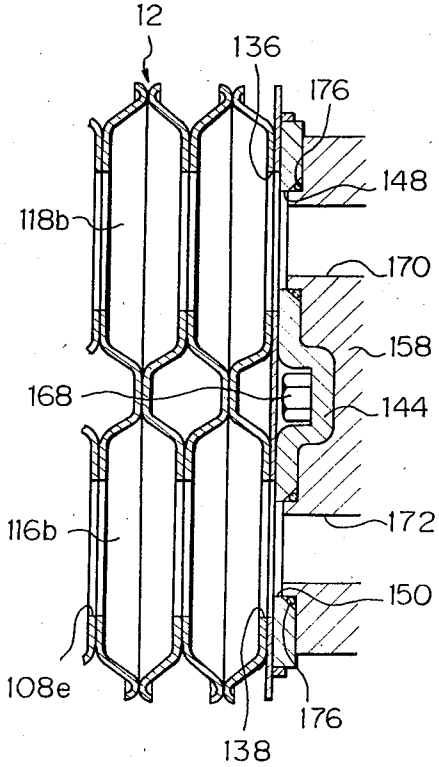
FIG. 10 is a sectional view of another embodiment of the present invention.

Referring to FIG. 10, another embodiment of the present invention is shown. This alternative embodment features uniquely configured spaces for receiving the O-rings 174 and 176. In the embodiment shown in FIGS. 2–9, the O-rings 174 and 176 respectively are received in annular recesses formed in the manifold block 140. In the embodiment of FIG. 10, on the other hand, the edges of the openings 148 and 150 of the mounting plate 144 are machined in such a manner that they define annular spaces each having a generally triangular section in cooperation with the manifold block 140. The O-rings 174 and 176 respectively are fit in the annular spaces between the mounting plate 144 and the annular block 140. The rest of the construction and arrangement is the same as those of the first embodiment and, therefore, will not be described any further with the same structural elements designated by like reference numerals.

In summary, it will be seen that the present invention provides a heat exchanger which eliminates the need for a temperature-sensing bulb or an external equalizer heretofore associated with an outlet conduit, contributing a great deal to cost-effective construction. This advantage is derived from the unique configuration which allows temperature and pressure at the outlet of the evaporator to be communicated to an expansion valve within a manifold block, which has the expansion valve integrally therewith and communicates to an inlet and an outlet formed in a single end plate.

The omission of the temperature-sensing bulb and external equalizer also promotes the ease of assembling the whole evaporator.

In addition, since the manifold block with the expansion valve is mounted on one side of the evaporator, nothing is located in front of the evaporator heat exchanger which constitutes resistance to the flow of air through the heat exchanger.

Various modifications will become possible for those skilled in the art after receiving the teachings of the present disclosure without departing from the scope thereof.

What is claimed is:

1. A heat exchanger comprising:

a plurality of hollow panels arranged in a stack with fins interspersed therebetween and each having right and left vertical fluid passageways therein and upper and lower headers communicating with upper and lower ends of said fluid passageways respectively;

said panels being arranged in front and rear groups such that a front right lower header communicates with lower ends of said front right fluid passageways, a front right upper header communicates with upper ends of said front right fluid passageways, a rear right upper header communicates with upper ends of said rear right fluid passageways and with said front right upper header, a rear right lower header communicates with lower ends of said rear right fluid passageways, a rear left lower header communicates with lower ends of said rear left fluid passageways and with said rear right lower header, a rear left upper header communicates with upper ends said rear left fluid passageways, a front left upper header communicates with upper ends of said front left fluid passageways and with said rear left upper header, and a front left lower header communicates with lower ends of said front left fluid passageways;

an end plate applied to an end of said stack and formed with an inlet opening and an outlet opening adjacent to said inlet opening each of which communicates to a fluid circulation path defined in said stack by said fluid passageways and said upper and lower headers of said hollow panels, said inlet opening communicating with one of said front right lower header and said front left lower header and said outlet opening communicating with the other of said front right lower header and said front left lower header respectively;

inlet and outlet manifold means mounted on said end plate for fluidly communicating said inlet opening of said end plate to an inlet conduit and said outlet opening to an outlet conduit;

expansion valve means built in said inlet and outlet manifold means for controlling a quantity of an incoming flow of fluid directed from said inlet conduit toward the fluid circulation path in the stack via the manifold means and the inlet opening of the end plate in response to a temperature and a pressure of an outgoing flow of the fluid directed from the fluid circulation path toward the outlet conduit via the outlet opening of the end plate and the manifold means.

2. A heat exchanger as claimed in claim 1, wherein the inlet and outlet manifold means comprises an inlet and outlet manifold block which is provided with a first passageway for the incoming flow of the fluid and a second passageway for the outgoing flow of the fluid.

3. A heat exchanger as claimed in claim 1, further comprising means for fixing the inlet and outlet manifold means to the end plate.

4. A heat exchanger as claimed in claim 3, wherein the inlet and outlet manifold means comprises an inlet and outlet manifold block which is provided with a first passageway for the incoming flow of the fluid and a second passageway for the outgoing flow of the fluid.

5. A heat exchanger as claimed in claim 4, wherein the fixing means comprising a mounting plate which is formed with openings aligning respectively with the inlet and outlet openings of the end plate and is rigidly connected to the end plate by brazing.

6. A heat exchanger as claimed in claim 5, wherein the fixing means further comprises a bolt and nut assembly for fastening the inlet and outlet manifold block to the mounting plate.

* * * * *